US007243432B1

(12) United States Patent
Rager

(10) Patent No.: US 7,243,432 B1
(45) Date of Patent: Jul. 17, 2007

(54) PENDULUM BOW SIGHT HAVING A VERTICAL PIN

(75) Inventor: Christopher A. Rager, Bozeman, MT (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 11/137,131

(22) Filed: May 25, 2005

Related U.S. Application Data

(60) Provisional application No. 60/575,786, filed on May 28, 2004.

(51) Int. Cl.
*F41G 1/467* (2006.01)

(52) U.S. Cl. ..... 33/265; 124/87

(58) Field of Classification Search ..... 33/265, 33/285; 124/86, 87
See application file for complete search history.

(56) References Cited

U.S. PATENT DOCUMENTS 3,212,190 A * 10/1965 Larson ..... 33/265
3,234,651 A 2/1966 Rivers
3,289,300 A * 12/1966 Jordan ..... 33/265
4,120,096 A 10/1978 Keller
4,368,581 A * 1/1983 Tullos ..... 33/265
4,535,544 A * 8/1985 Jones et al. ..... 33/265
4,580,349 A 4/1986 Webb et al.
4,616,422 A 10/1986 Gaddy
4,711,036 A 12/1987 Morris
4,720,919 A 1/1988 Saunders
4,796,364 A 1/1989 Amacker
4,846,141 A 7/1989 Johnson
4,884,347 A 12/1989 Larson
4,967,478 A 11/1990 Sherman
4,974,328 A 12/1990 Lowry
5,086,567 A 2/1992 Tutsch
5,103,568 A 4/1992 Canoy
5,121,547 A 6/1992 Littlejohn
5,131,153 A 7/1992 Seales
5,253,423 A 10/1993 Sullivan, Jr. et al.
5,303,479 A 4/1994 Rudovsky
5,305,530 A 4/1994 Robertson, Jr. et al.
5,347,722 A * 9/1994 Sefsick ..... 33/265
5,383,278 A * 1/1995 Kay ..... 33/265
5,383,279 A 1/1995 Tami
5,388,336 A 2/1995 Pomaville
5,419,051 A 5/1995 Barngrover
5,454,169 A * 10/1995 Keller ..... 33/265
5,465,491 A 11/1995 Thell
5,509,402 A 4/1996 Sappington (Continued)

OTHER PUBLICATIONS

Trophy Ridge On-Line Catalog, Mantis Sights, http://www.trophyridge.com/catalog/04catalogmantis.html, 3 pages (printed Apr. 19, 2004).

*Primary Examiner*—R. Alexander Smith
(74) *Attorney, Agent, or Firm*—Wood, Emhardt, Moriarty, McNett & Henry LLP

(57) ABSTRACT

The invention is directed to a bow sight that is constructed to automatically compensate for arrow drop when the elevation of the target and the shooter is varied. In one embodiment, the bow sight includes a frame having an upper portion and a lower portion that cooperate to define a target viewing opening, the lower portion of the frame including a sight pin support that is pivotally movable relative to the upper portion of the frame.

12 Claims, 4 Drawing Sheets

U.S. PATENT DOCUMENTS 5,524,351 A * 6/1996 Pinson et al. ..... 33/265
5,539,989 A 7/1996 Potter
5,560,113 A 10/1996 Simo et al.
5,634,278 A 6/1997 London
5,676,122 A 10/1997 Wiseby et al.
5,685,081 A 11/1997 Winegar
5,914,775 A 6/1999 Hargrove et al.
5,946,812 A 9/1999 Slates
6,079,111 A 6/2000 Williams et al.
6,094,829 A * 8/2000 Koestler, III ..... 33/265
6,145,208 A 11/2000 Savage
6,199,286 B1 3/2001 Reed, Jr. et al.
6,418,632 B1 7/2002 Kalfayan
6,418,633 B1 7/2002 Rager
6,430,821 B1 8/2002 Cionni
6,446,347 B1 9/2002 Springer
6,560,884 B1 5/2003 Afshari
6,725,854 B1 4/2004 Afshari
7,000,327 B2 * 2/2006 Rager ..... 33/265
2002/0100176 A1 8/2002 Savage
2002/0100177 A1 8/2002 Savage
2002/0112358 A1 8/2002 Savage
2004/0006879 A1 1/2004 Afshari
2004/0088871 A1 5/2004 Afshari
2004/0111900 A1 6/2004 Rager
2005/0138824 A1 * 6/2005 Afshari ..... 33/265

* cited by examiner

FIG. 5
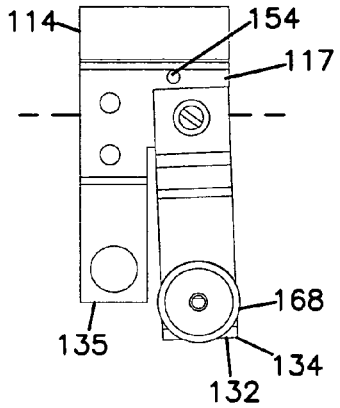
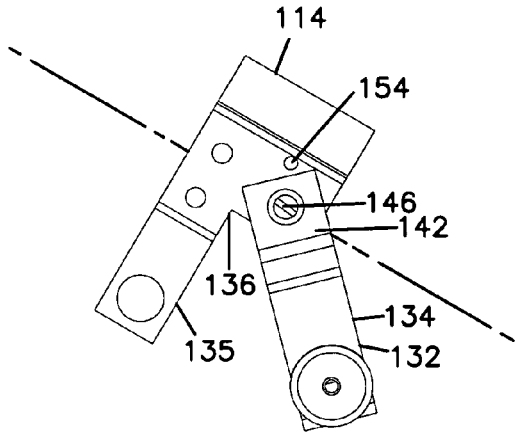
FIG. 6
FIG. 7
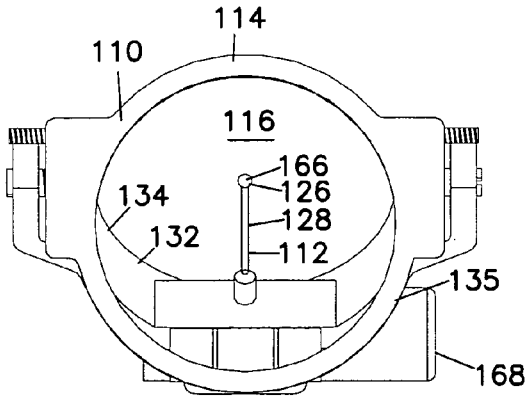
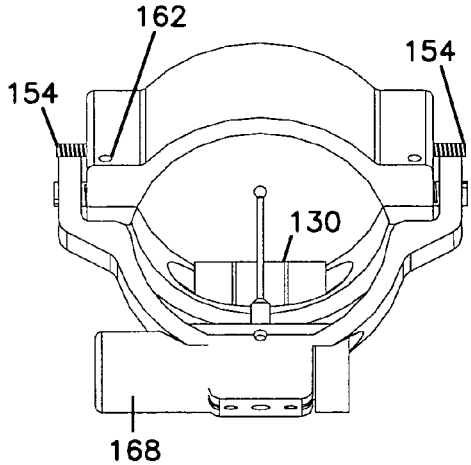
FIG. 8

PENDULUM BOW SIGHT HAVING A VERTICAL PIN

CROSS-REFERENCE TO RELATED APPLICATION

This application claims the benefit of U.S. Provisional Patent Application Ser. No. 60/575,786, filed May 28, 2004, which application is hereby incorporated by reference in its entirety.

TECHNICAL FIELD

This invention relates to archery equipment and more particularly to a sighting apparatus for use with an archery bow, commonly referred to as a bow sight. In particular, the bow sight of this invention provides vertical sighting compensation, which is desirable when shooting at targets positioned at different heights relative to the shooter.

BACKGROUND

Many bow sight designs and configurations are known. Bow sights often have multiple sight points that are used when shooting arrows at targets positioned at different distances from the archer. Many bow sights include multiple sight points attached to horizontal pins; examples of such bow sights are shown, for example, in U.S. Pat. Nos. 5,103,568; 5,676,122; and 5,685,081. A more recent development has been a bow sight with vertical pins having fiber optic sight points at the ends of the pins; an example of such a bow sight is shown in U.S. Pat. No. 6,418,633. A number of U.S. patents disclose bow sights having various other arrangements of sight points. See, for example, U.S. Pat. Nos. 3,234,651; 4,120,096; 5,086,567; and 5,131,153.

Until recently, bow sights have been designed to provide accurate sighting over changing distances only where the elevation difference between the target and the shooter remains relatively constant. Generally, each sight point is designed to be calibrated at a different distance measured from the shooter while the vertical displacement, or elevation, between the shooter and the target is assumed to be constant. As such, if a bow having sight points adjusted to be accurate over level ground is used to shoot at a target located either above or below the shooter, the resulting shot will be off target. More specifically, if the target is below the shooter, the sight will overcompensate for the arrow drop due to gravity and the shot will be too high.

To ensure accuracy, traditional sight points require manual readjustment whenever the relative elevation difference between the shooter and the target is varied. New bow sites have been developed that automatically readjust to maintain accuracy when the bow is used to shoot targets located at different elevations relative to the shooter. See, for example, U.S. Pat. Nos. 6,145,208; 5,253,423; and 5,121,547. Nonetheless, the current sights in this field can be improved with respect to their accuracy, ease of use, reliability, and simplicity.

SUMMARY

One inventive aspect of the disclosure is directed to a bow sight having a sight point that is pivotally connected to the bow. Tilting or angling of the bow causes pivoting of the sight point. This pivoting enables the sight to compensate for elevation changes between the shooter and the target.

In one embodiment, the bow sight includes a fixed structure and a pivotal structure. The pivotal structure supports a sight point and is connected to the fixed structure, which is connected to a bow. The pivotal structure pivots with respect to the bow when the bow angle is changed; as such, the bow sight of the present invention automatically adjusts to changes in shooting angle.

BRIEF DESCRIPTION OF THE DRAWINGS

FIG. 5 is a side elevation view of the bow sight of FIG. 1 in a first position;

FIG. 6 is a side elevation view of the bow sight of FIG. 1 in a second position;

FIG. 7 is a front elevation view of the bow sight of FIG. 1 in a second position; and FIG. 8 is a back perspective view of the bow sight of FIG. 1 in a second position.

DETAILED DESCRIPTION

In the following description of the preferred embodiment, reference is made to the accompanying drawings, which form a part hereof, and in which is shown, by way of illustration, specific embodiments in which the invention may be practiced. It is to be understood that other embodiments may be utilized and structural changes may be made without departing from the scope of the present invention.

Figure 1:
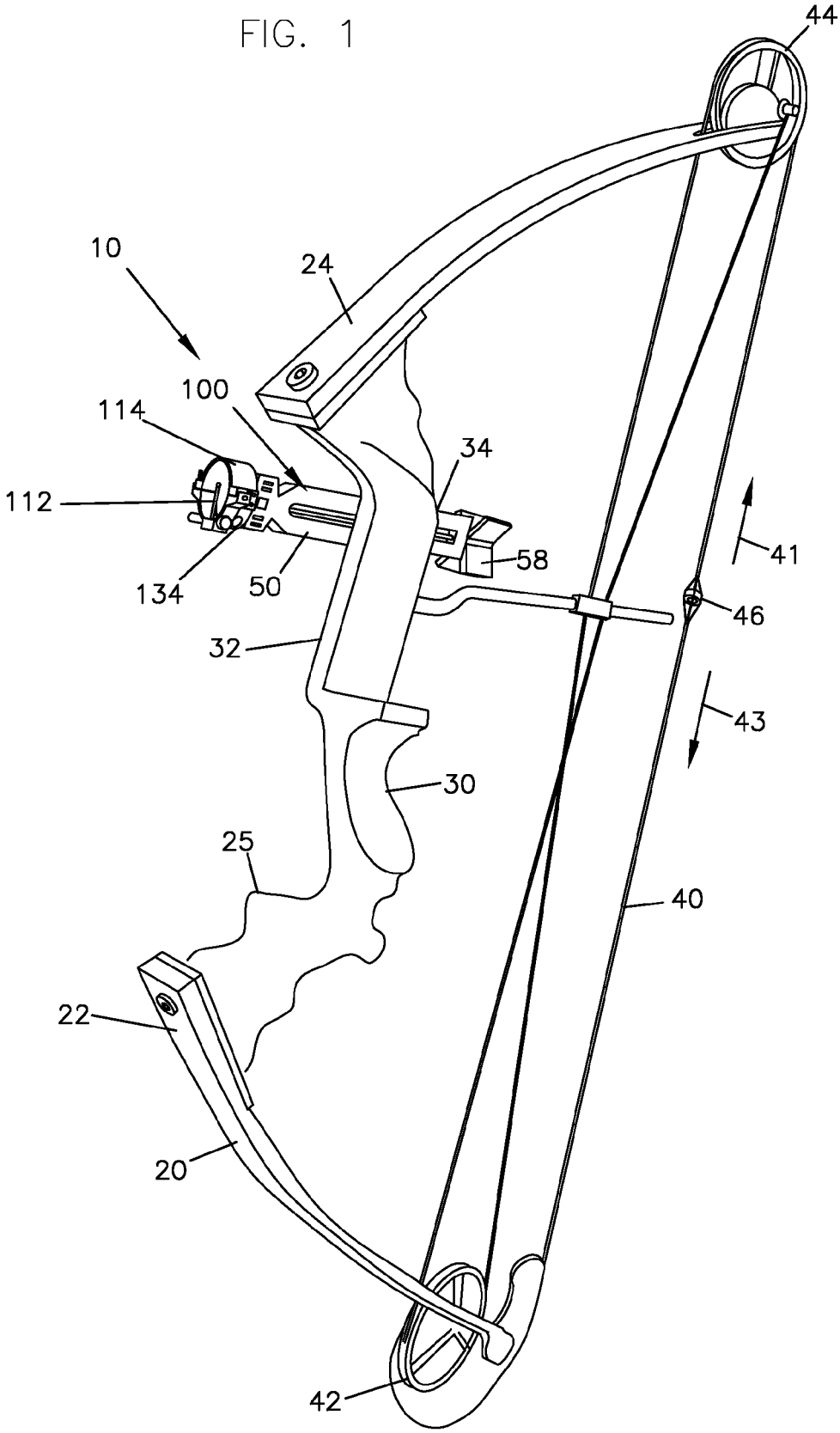
FIG. 1 is a perspective view of a bow incorporating a bow sight having features in accordance with the principles of the present disclosure.

Referring to FIG. 1, a bow 10 is shown. Bow 10 includes a frame 20 having a lower arm 22, an upper arm 24, and a handle portion 25 with a grip 30 connected to and supporting lower arm 22 and upper arm 24. The bow 10 has a front surface 32 and an opposite back surface 34. When the bow 10 is positioned for shooting, the direction from the lower arm 22 towards the upper arm 24 is the vertical upward direction 41 and the direction from the upper arm 24 to the lower arm 22 is the vertical downward direction 43. In addition, when the bow 10 is positioned for shooting, the front surface 32 of the bow 10 is positioned facing the target and back surface 34 of the bow 10 is facing the archer. A bow sight 100 is mounted to the bow 10. The front and back surfaces of the bow sight 100 are opposite the front 32 and back 34 surface of the bow 10. For example, the front surface of the bow sight 100 is the side that faces the archer and the back surface 117 of the bow sight 100 is the side opposite the front surface.

Still referring to FIG. 1, bow 10 includes a string 40 connected to lower arm 22 and upper arm 24. String 40 provides the propulsion of the arrow shot from bow 10. Bow 10 is illustrated as a compound bow, with cam 42 at the end of lower arm 22 and cam 44 at the end of upper arm 24. Bowstring 40 extends between cam 42 and cam 44. Cams 42, 44 provide a mechanical advantage to the archer when drawing bowstring 40. A peep sight 46 is positioned on bowstring 40 to facilitate targeting and aiming.

Figure 2:
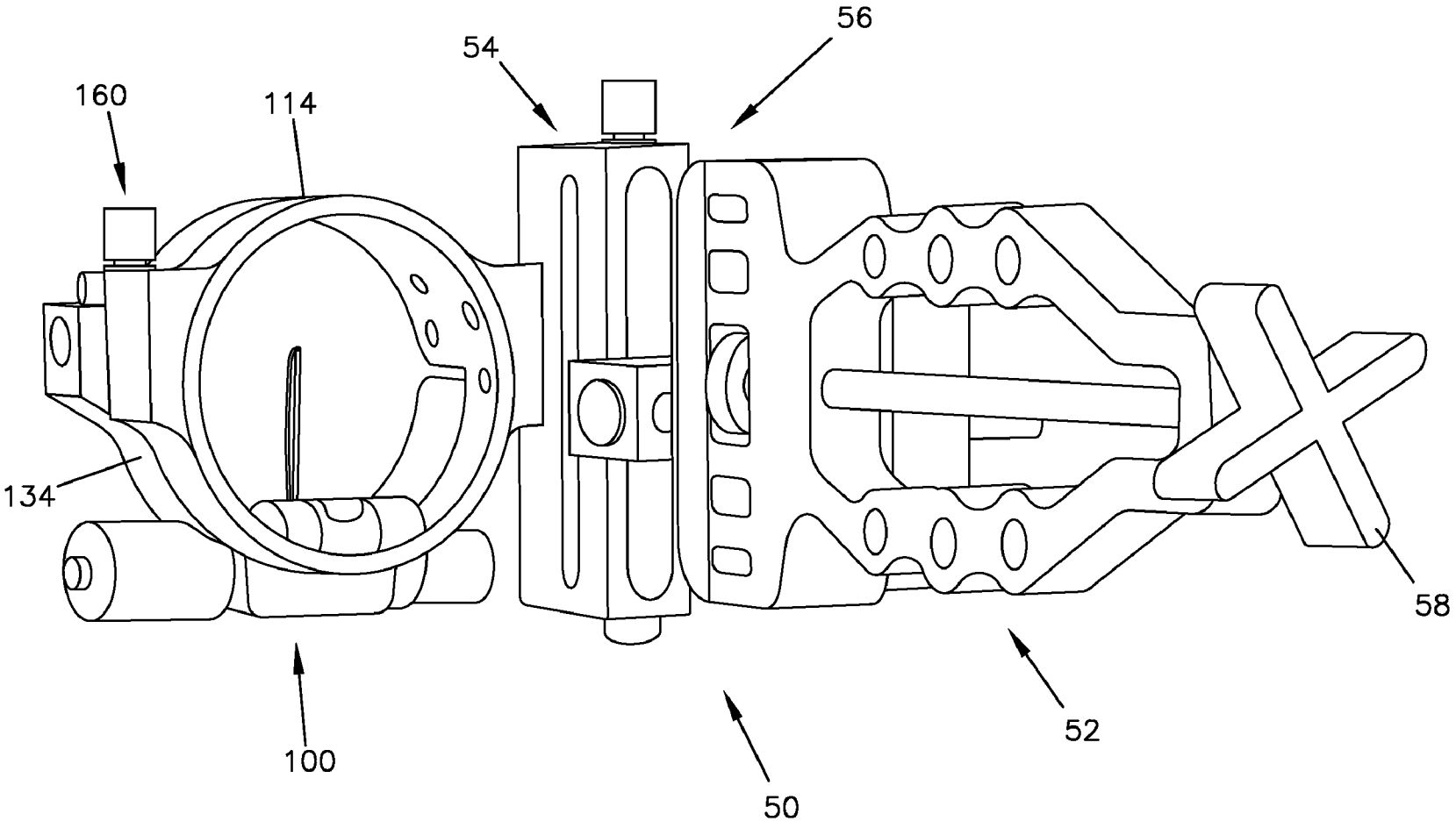
FIG. 2 is a perspective view of the bow sight of FIG. 1.

Referring to FIG. 2, the bow sight 100 is shown mounted to a vertical adjustment arm 50. Adjustment arm 50 has a first end 52 configured for attachment to bow 10 and has a second end 54 configured for attachment to bow sight 100.

Adjustment arm 50 includes a height adjustment mechanism 56, which can be used to change the relative height of bow sight 100 to the bow 10. The adjustment arm 50 includes a knob 58 that the archer can turn to change the vertical height of the sight point. The sight point is raised for longer distance shots and lowered for shorter distance shots. Further details regarding the vertical adjustment arm are disclosed in U.S. patent application Ser. No. 11/137,116, and entitled Bow Sight Having Vertical Positioning Mechanism, which is being filed on a date concurrent herewith.

Figure 3:
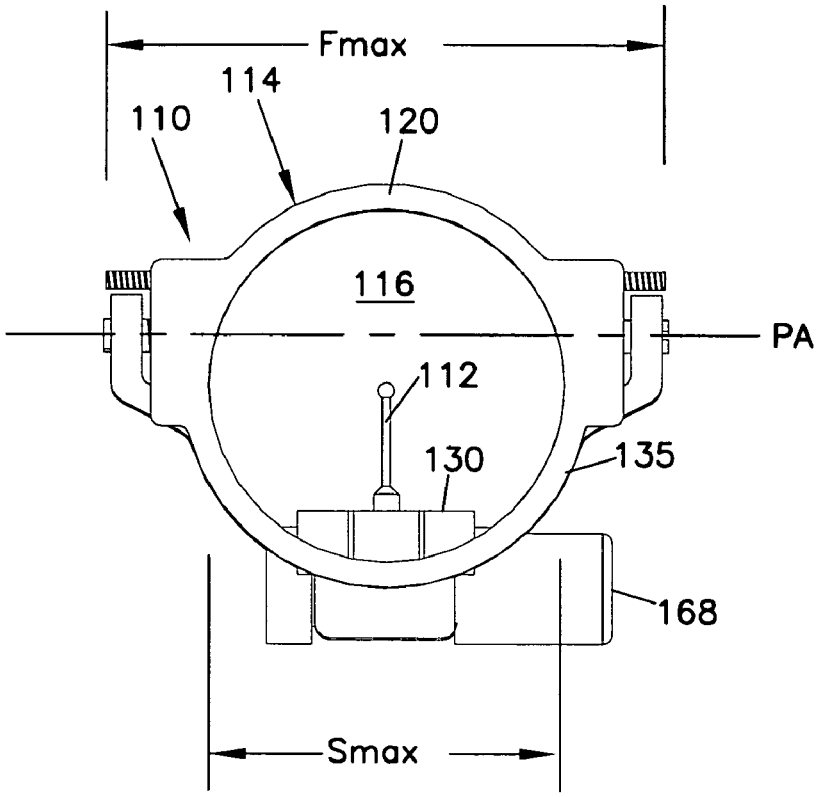
FIG. 3 is a front elevation view of the bow sight of FIG. 1 in a first position.
Figure 4:
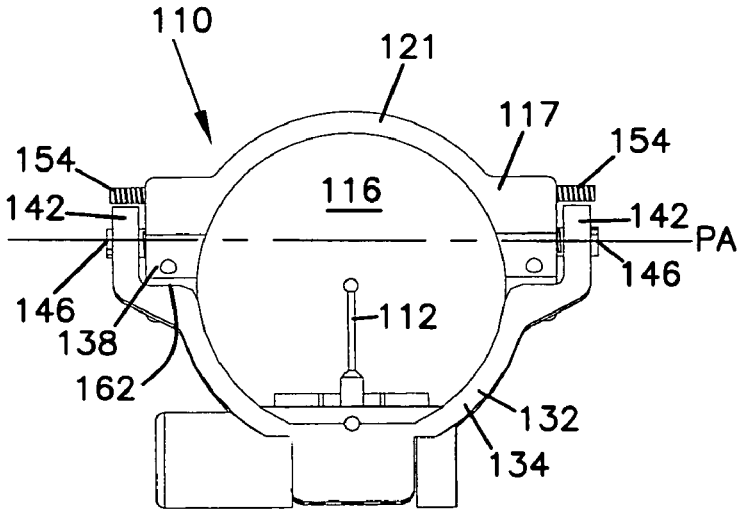
FIG. 4 is a back elevation view of the bow sight of FIG. 1 in a first position.

Referring to FIGS. 3 and 4, the bow sight 100 includes a frame 110 that defines a target viewing opening 116 through which a target can be viewed to visually frame the target for sighting. The frame 110 includes a first frame member 114 including a front portion defining a full ring 120, and a rear portion defining an upper partial ring 121. The frame 110 also includes a second frame member 134 in the form of a lower partial ring 132 pivotally connected to the upper partial ring 121 of the first frame member 114. The upper partial ring 121 cooperates with the lower partial ring 132 to form a substantially full ring that substantially circles the target viewing opening 116. The bow sight 100 also incuse a sight pin 112 carried by the lower partial ring 132. The lower partial ring 132 is adapted to swing or pivot relative to the first frame member 114 in a pendulum-like manner when the sight 100 is moved from a horizontal sight line (as shown in FIG. 5) to a downwardly angled sight line (as shown in FIG. 6). This pivoting action functions to raise a sight point 126 of the sight pin 112 as the bow 10 is aimed downwardly. The sight point is raised to compensate for the downward angle of the bow 10 which otherwise can cause archers to shoot above their intended target location. In one example embodiment the diameter of the target viewing opening is at least 1.5 inches or greater.

It should be understood that when the bow sight 100 is mounted to a bow 10 and the bow 10 is position for shooting at a target located at the same elevation as the bow 10, the sight line that extends between the peep sight 46 and the sight point 126 is orientated in a neutral angle relative to a horizontal plane. On the other hand, if the bow 10 is positioned for shooting at a target located at a lower elevation with respect to the bow 10 (i.e., aimed downward), the sight line that extends between the peep sight 46 and the sight point 126 is orientated at a negative angle (i.e., downward angle) with respect to a horizontal plane.

To shoot the bow, the archer first estimates the distance to the target, and can set the height of the sight 100 relative to the bow 10 accordingly. The archer draws the string 40 and then peers from the peep sight 46 through the target viewing opening 116 to locate the target. The archer precisely aims the bow 10 by establishing a sight line that extends from the peep sight 46 through the viewing opening 116 and the sight point 126 to the target. Once the peep sight 46, the sight point 126, and the target are all aligned, the string 40 is released to shoot the arrow at the target. When shooting from elevations higher than the target (e.g., a tree stand), the pendulum effect of the lower partial ring 132 moves the sight point 112 to compensate for the downward angle of the sight line.

Referring to FIGS. 3, 4, and 7, the target viewing window opening 116 is preferably relatively open so as to provide a relatively large and clear field of vision to facilitate aligning the target relative to the sight point 126. The target viewing opening 116 need not, but could include clear glass or plastic positioned across the target viewing opening 116. The target viewing opening 116 in some embodiments is unobstructed such that it includes no structures therein that are not visually helpful in proper aligning the sight points 126 with the target. Unobstructed sight windows may, nonetheless, include the shaft 128 of a sight pin 112 and other structure for facilitating aiming a bow 100 such as a level 130.

In the embodiment shown, the frame 110 defines a generally circular and visually continuous target viewing opening 116. In addition, the frame 110 and the target viewing opening 116, includes a ratio of the maximum width of the frame 110 (Fmax) to the maximum width of the target viewing opening 116 (Smax) that is no more than 1.5. With such a ratio the frame 110 and the target viewing opening 116 are relatively close in size. In the embodiment shown, the frame surrounds the sight point 126 to protect it from external impact.

Referring to FIGS. 4-8, the lower partial ring 132 is attached to the frame 110 in a manner that maximizes the size of the target viewing opening 116. As shown in FIG. 5, the first frame member 114 defines a notched out back portion 136 that is shaped to nest the lower partial ring 132. The lower partial ring 132 is pivotally attached below the partial ring 121 of the first frame member 114 and behind a front lower portion 135 of the first frame member 114. The lower partial ring 132 is oriented behind the first frame member 114 such that at least a portion of the lower partial ring 132 is hidden from a front view when an archer peers through the target viewing opening 115 from the front side of the sight 100 (see FIG. 3). In other words, the arrangement of the frame member 114 and the lower partial ring 132 can be coaxial, which provides a visually clean low profile appearance. In certain embodiments a majority or substantially all of the ring 132 is hidden behind the first frame member 114 at least when the sight 100 is sighted along a horizontal sight line. Such an arrangement, avoids obstructing the target viewing opening 116. Also, in the embodiment shown, the notched out back portion 136 is sized such that the back surface 117 of the bow sight 100 is in a single vertical plane when the sight 100 is sighted along a horizontal sight line.

The second frame member 134 can be U-shaped in that it includes a two opposed connected arms 142. In the embodiments shown, the arms 142 define a generally semi-circular shape. The arms 142 are positioned to straddle the exterior of the upper partial ring 121. The two arms 142 can include pivot pins 146, such as screw, for attachment of the second frame member 134 to the upper partial ring 121. The pivot pins 146 define a pivot axis PA of the second frame member 134. The pivot axis PA preferably is oriented to intersect the target viewing opening 116. However, as discussed above, it is preferred for the target viewing opening 116 to be substantially free of obstructions. Therefore, while the pivot axis PA intersects the target viewing opening 116, it is preferred for no portion of the pivot pins 146 substantially projects into or across the target viewing opening 116.

The support frame 110 can also include one or more stops 154, which limit the range of motion of the second frame member 134 relative to the first frame member 114. In the embodiment shown, the stops are shown as bosses. In addition to the stops 154, the sight 100 includes a locking mechanism 160 for limiting the range of pivotal movement of the second frame member 134 relative to the first frame member 114, and for selectively locking the second frame member 134 in the position of FIG. 5. Though possible, the locking mechanism 160 need not totally prevent the sight pin 112 from moving relative to the support frame 110. The locking mechanism 160 can include a fastener such as a set screw 160 (shown in FIG. 2) that threads downwardly through a vertical tapped hole 162 (see FIGS. 4 & 8) defined by the upper partial ring 121. The tapped hole 162 passes through a downwardly facing surface 138 of the upper partial ring 121. The downwardly facing surface 138 opposes an upwardly facing surface 152 defined by a shoulder of the lower partial ring 132. The downwardly facing lower surface 138 is rounded to prevent interference with the pivoting motion of the lower partial ring 132. The set screw shown in FIGS. 1 and 2 has been removed for clarity in FIGS. 3-8.

Referring to FIG. 7, the sight pin 112 and sight point 126, which the archer uses for targeting an object are shown. Sight point 126 may be integral with sight pin 112 or be a separate piece from the sight pins 112. A sight point can be any point or indicia of any sort that is visually placed in line with the target to be shot at for assisting in the proper aiming of the bow 10. Sight points 126 can be circular shapes, other geometrical shapes, colored dots, the end of an optical fiber 166, or simply the end of sight pin 112.

The sight point 126 is preferably an optical sight point defined by the end of a light collecting member such as an optical fiber 166. In such embodiments, the end of the fiber optic fiber 166 is secured to the free end of a relatively rigid supporting pin 112 to act as a sight point 126. Since the optical fiber 166 collects light along its length, to maximize the brightness of the sight point, it is desired to provide an increased length of optical fiber 166. To increase the length of optical fiber 166, the optical fiber 166 extends downwardly from the sight point 126 along the back side of the pin 112, through the bottom of the lower partial ring 132, through the center of a hub 168, and then wrapped multiple times about the exterior of the hub 168. FIG. 8 schematically shows the fiber 166 wrapped about the hub 168. A transparent protective sleeve (not shown) can be mounted over the hub 168 to hold the wraps of optical fiber in place. A weight 190 can also be attached to the hub to enhance pivoting of the second frame member 134.

The disclosure is also directed to a method of assembling the bow sight 100 that includes at least the steps of providing a lower partial ring 132 and a frame member 114 and coupling the lower partial ring 132 to the frame member 114 such that the ring 132 and the frame member 114 define an unobstructed sight window and the ring is pivotally movable with respect to the frame.

In the depicted embodiment, the rings have generally circular shapes. However, as defined herein, the term "ring" is not limited to circular shapes. To the contrary, square rings, oval rings, and other shapes suitable for framing a target viewing opening are included within the definition of ring. The term viewing opening includes fully enclosed openings as well as partially enclosed openings such as U-shaped openings (e.g., openings with closed bottoms and sides and opened tops) as well as other partially enclosed openings. As used herein, a full ring means a ring that forms an endless boundary about the target viewing opening 116. A substantially full ring means a ring that forms a boundary that surrounds at least 75% of the target viewing opening 116. A partial ring means a member that forms a boundary that surrounds less than 75% of the target viewing opening 116. A "half ring" means a member that forms a boundary that surrounds approximately 50% of the target viewing opening 116.

Structures through which a target can be viewed can be referred to as a target viewing channels, sighting openings, sight windows, or like terms. Structures for supporting a sight pin, such as the lower partial ring 134, can be referred to as pin supports, pin support members, sight point supports or sight pin supports members. Structures capable of swinging about a pivot can be referred to as pivot members, pendulum members, pendulums, or like terms. Structures capable of protecting pins can be referred to as cages, protective members, shielding members or like terms.

The materials used to construct the bow sight 100 can include metals (e.g., aluminum, steel, brass), plastics (e.g., polycarbonate, acrylics), and/or ceramics and composite materials or other materials.

The above specification and examples provide a complete description of the assembly and use of the invention. It is to be understood that other embodiments may be utilized and structural changes may be made without departing from the present invention. Since many embodiments of the invention can be made without departing from the spirit and scope of the invention, the invention resides in the claims hereinafter appended.

What is claimed is:

1. A bow sight comprising:

a frame including an upper portion and a lower portion that cooperate to define a target viewing opening, the lower portion being pivotally movable relative to the upper portion of the frame; and a sight point carried by the lower portion, wherein the upper portion comprises a front portion and a rear portion, wherein the front portion cooperates with the rear portion to define a notched out back constructed to at least partially nest the lower portion below and behind the upper portion.

2. The bow sight according to claim 1, wherein the frame further comprises a positive stop constructed to engage and limit the range of motion of the sight point with respect to the upper portion.

3. The bow sight according to claim 1, wherein the frame further comprises a locking device constructed to obstruct the sight point from moving relative to the upper portion.

4. The bow sight according to claim 1, further comprising at least one sight pin attached to the lower portion for supporting the sight point.

5. The bow sight according to claim 1, wherein the lower portion includes a U-shaped profile having two opposed arms constructed to pivotally attach to the upper portion.

6. The bow sight according to claim 1, wherein the ratio of max width of the frame to the max width of the target viewing opening is no more than 1.5.

7. The bow sight according to claim 1, wherein the target viewing opening includes a generally circular periphery.

8. The bow sight according to claim 7, wherein the diameter of the target viewing opening is at least 1.5 inches or greater.

9. A bow sight comprising:

a front member including a front portion and a back portion, the front portion of the front member defining a substantially full ring;

a pendulum member that is positioned adjacent the back portion of the front member and is pivotally moveable relative to the front member, wherein the pendulum member includes arms that straddle opposite sides of the front member and wherein the pendulum member defines a partial ring; and a sight pin carried by the pendulum member.

10. The bow sight of claim 9, wherein the front portion of the front member defines a full ring.

11. The bow sight of claim 9, wherein the back portion of the front member defines an upper half ring, and the pendulum member defines a lower half ring.

12. The bow sight of claim 9, further comprising a locking member for limiting the range of pivotal motion of the pendulum member.

* * * * *